US007079785B2

(12) United States Patent
Koshimura et al.

(10) Patent No.: US 7,079,785 B2
(45) Date of Patent: Jul. 18, 2006

(54) IMAGE DEVELOPING APPARATUS TO DEVELOP A LATENT IMAGE IN A DEVELOPING AREA ON AN IMAGE BEARING MEMBER

(75) Inventors: Yasushi Koshimura, Hino (JP); Junichi Koiso, Hachioji (JP); Kanehiro Watanabe, Sagamihara (JP); Takayuki Horie, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 27 days.

(21) Appl. No.: 10/876,022

(22) Filed: Jun. 25, 2004

(65) Prior Publication Data

US 2005/0100360 A1 May 12, 2005

(30) Foreign Application Priority Data

Nov. 11, 2003 (JP) ..... 2003-380873

(51) Int. Cl.
*G03G 21/20* (2006.01)

(52) U.S. Cl. ..... 399/94

(58) Field of Classification Search ..... None
See application file for complete search history.

(56) References Cited

FOREIGN PATENT DOCUMENTS

JP 2002091158 A * 3/2002

* cited by examiner

*Primary Examiner*—Quana Grainger

(57) ABSTRACT

An image developing apparatus having a rotating member to bear developing agent in a housing of the image developing apparatus and to convey the developing agent of latent images onto paper transfer sheets opposite a image bearing member, wherein a part of the rotating member rotatably supported by the housing of the image development apparatus is exposed to the exterior of the housing of the image development apparatus so that the exposed portion of the rotating member radiates heat accumulated of the rotating member.

25 Claims, 4 Drawing Sheets

FIG. 3 ( a )
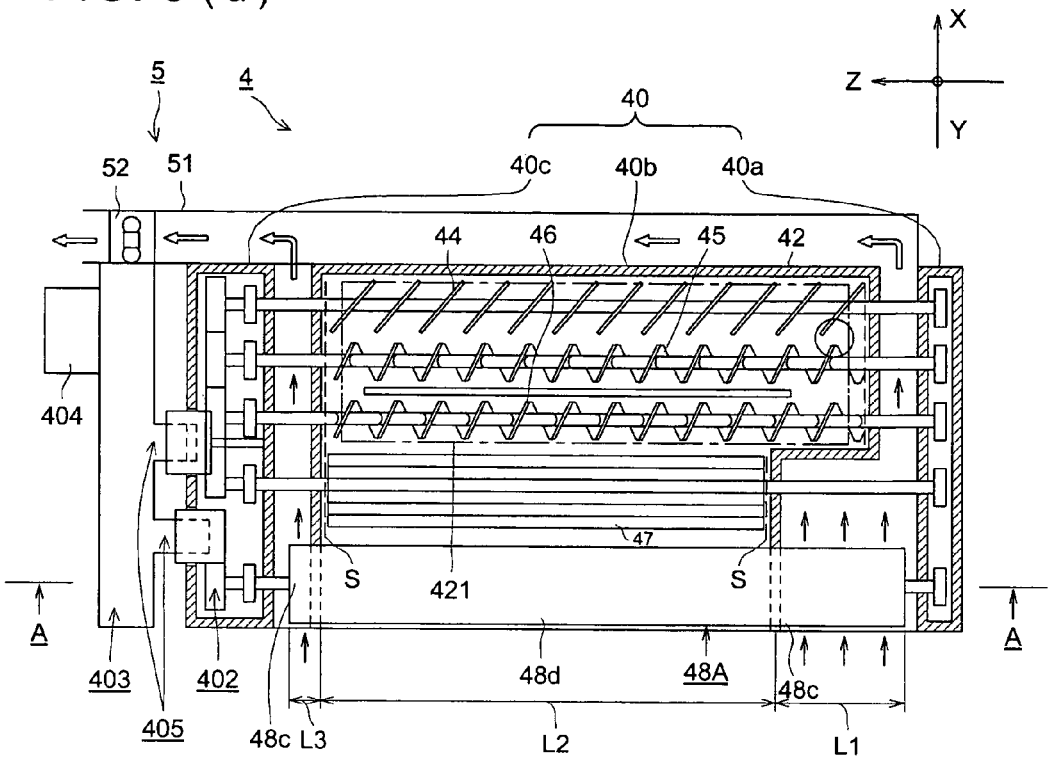
FIG. 3 ( b )
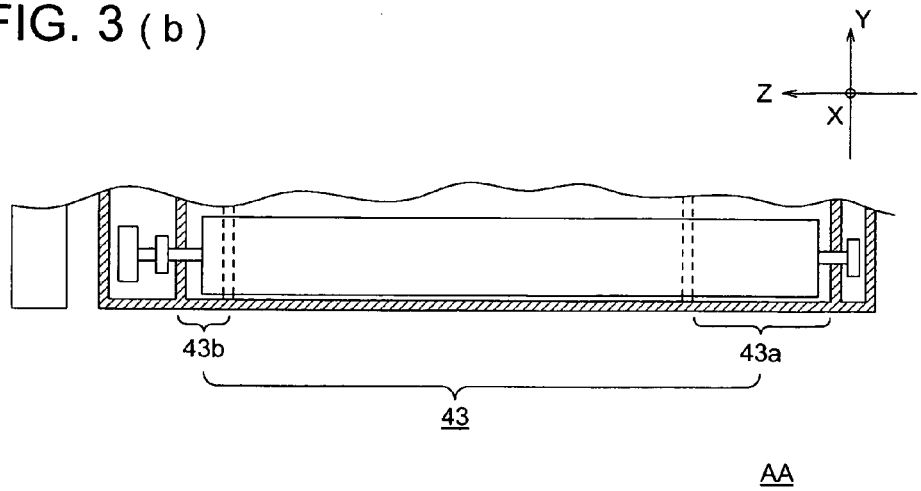

IMAGE DEVELOPING APPARATUS TO DEVELOP A LATENT IMAGE IN A DEVELOPING AREA ON AN IMAGE BEARING MEMBER

BACKGROUND OF THE INVENTION

1. Field of the Invention

The present invention relates to an image developing apparatus and an image forming apparatus incorporating the image developing apparatus.

2. Related Art

Known as an image forming apparatus, is an apparatus comprising a latent image forming section which forms electrostatic latent images on an image forming device, an image developing apparatus which forms toner images, a transfer unit which transfers the toner images onto paper transfer sheets, a fixing apparatus which fixes the toner images on the paper transfer sheets and a cleaning device, which cleans the image forming device after transferring the images. An image developing apparatus, which is used in the image forming apparatus, transfers the toner carried by a developing sleeve to a developing area provided opposite the image bearing member.

In recent years, trends such as power saving, colorization and high-speed copy-processes etc. have been getting strong movement. In order to save energy, firstly a low softening point developing agent has been used. Further, in regard to the colorization, when developing apparatuses for developing agents of Y (yellow), C (cyan) and k (black) are integrated compactly, heat of friction generated at shaft bearing sections in a small image forming apparatus, heat generated by motors and heat generated between developing agent and a rotating member are easily generated. Further, heat generation by motors, heat generated by friction between developing agent and rotating members are easily generated since the rotating member rotates at a high speed in order to conduct high-speed copy processes. Consequently, developing agents in the image developing apparatus are easily welded to the developing sleeve in the image developing apparatus and degradation of the developing agent easily occurs when temperature rises.

As to overcome of these drawbacks, a technique to prevent temperature-rise by cooling the surface of a developing sleeve by contacted a developing agent-supplying roller exhibiting a cooling function provided in an image developing apparatus is disclosed in Japanese Patent Application Open to Public Inspection 2001-5280. However, problems concerning complications of configuration, which are needed to provide a cooling function to cool the developing agent-supplying roller, and low cooling efficiency since the developing agent-supplying roller indirectly cools the developing roller. Another technique is to radiate heat from the developing sleeve through an electrostatic charging blade, which conducts electrostatic-charges by touching the developing agent on the developing sleeve, is disclosed in Japanese Patent Application Open to Pubic H7-248673. However, problem is that heat of the developing sleeve is more difficult to radiate away than employing an electrostatic charging blade.

SUMMARY OF THE INVENTION

The first aspect of this invention is that a developing apparatus including a rotating member rotatably supported by the housing of the developing apparatus, the rotating member has an exposed portion to the outside of the housing, to radiate heat accumulated in the rotating member from the rotating member.

The second aspect of this invention is that a developing apparatus including a container to hold development agent, a rotating member to carry the development agent, a driving force transmitting device to transfer driving force to the rotating member wherein space between the driving force transmitting device and the container is provided.

BRIEF DESCRIPTION OF THE DRAWINGS

The present invention will become more fully understood from the detailed description given herein below and the accompanying drawings which are given by way of illustration only, and thus are not intended as a definition of the limits of the present invention, and herein:

FIG. 3 is a cross-sectional plan view (a), showing a cross section of a rotating member of another image developing apparatus structure and cross section AA of cross sectional side view (b) of the rotating member.

DESCRIPTION OF THE EXEMPLARY EMBODIMENTS

Embodiments of the present invention, an image developing apparatus and an image forming apparatus employing the image developing apparatus, will be explained based on drawings of the present invention.

Figure 1:
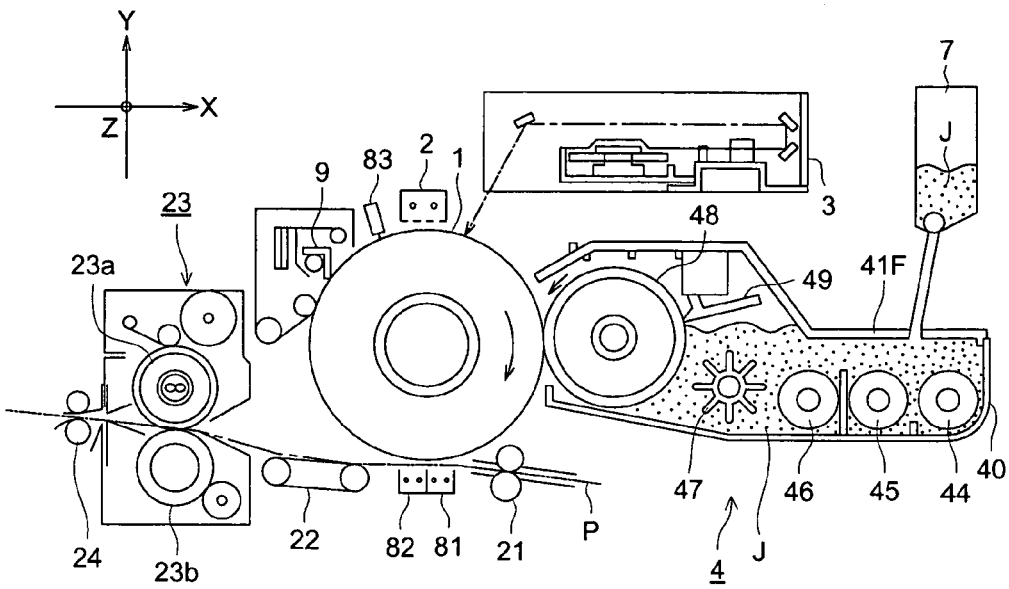
FIG. 1 is a cross sectional drawing of a structure of an image forming apparatus using an embodiment of the present invention.
Figure 2:
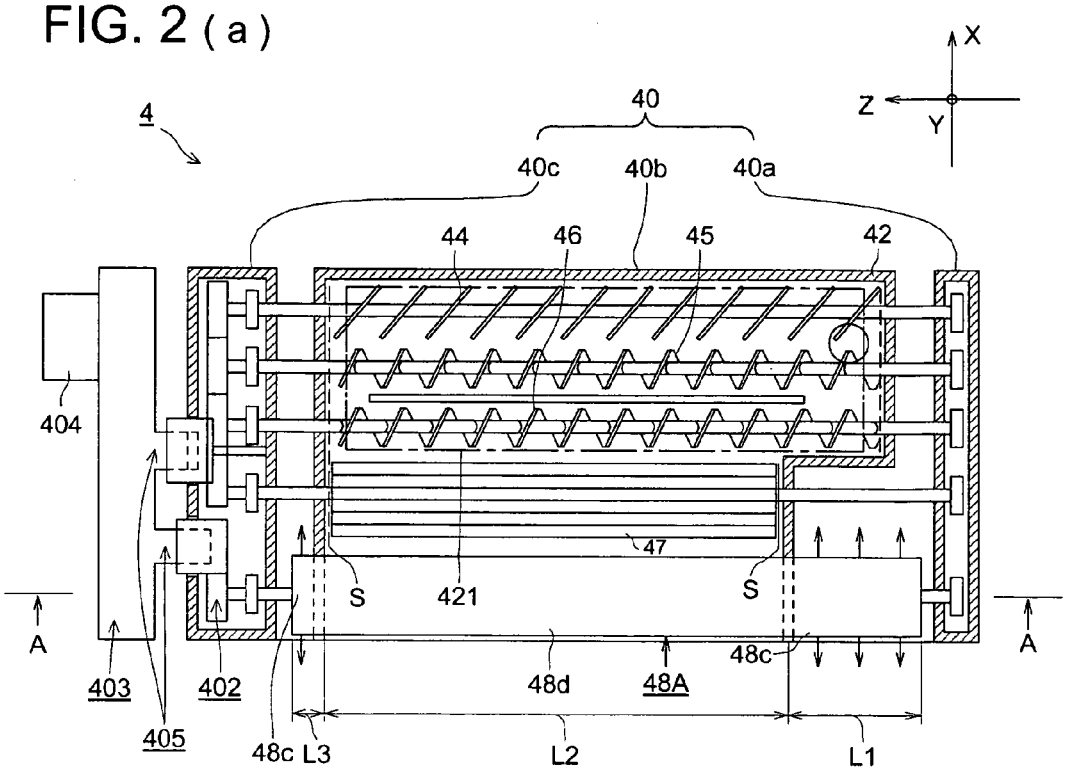
FIG. 2 is a cross-sectional plan view (a), showing a cross section of a rotating member of an image developing apparatus structure shown in FIG. 1 and cross section AA of a cross sectional side view (b) of the rotating member.
Figure 2:
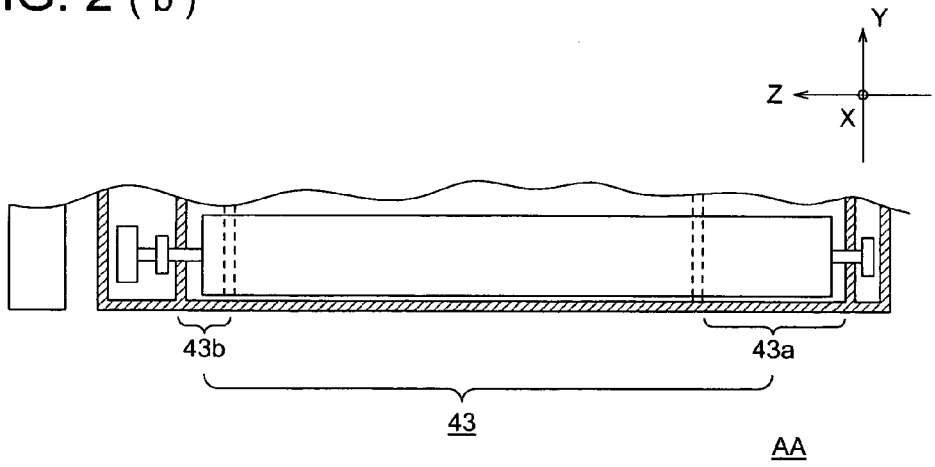

FIG. 1 is a cross-sectional drawing which showing an image forming apparatus employing an image developing apparatus of the present invention. The X-axis is defined as the left and right axis of an image forming apparatus when viewed from the front of the image forming apparatus, the Y-axis corresponds to the vertical axis and the Z-axis is from the front to the rear.

Image bearing member 1 is a drum shaped image bearing member whose cylindrical circumference surface is coated by an organic semiconductor, and rotates in the arrowed direction shown in FIG. 1. Electrostatic charging device 2 is a scorotron charging device to form a predetermined uniform electrostatic pole and voltages. Image developing device 3 forms electrostatic latent images by radiating laser beams onto the surface of image bearing member 1, being uniformly charged. Image developing apparatus 4 conveys toner onto image bearing member 1 by rotating developing sleeve 48 provided opposite of image bearing member 1. Toner-hopper 7 is provided above image developing apparatus 4 to store developing agent J (toner) and to supply a predetermined amount of developing agent J from toner-hopper 7 into image developing apparatus 4. Transfer electrode 81 transfers the unfixed toner images formed on image bearing member 1 onto transfer sheets via transfer electrodes 81. Separation corona unit 82 is a transfer electrode, which causes image-bearing member 1 to repel paper sheets P.

Paper sheets P supplied from a paper sheet feeder are supplied by paired resist rollers 21, which are synchronized with toner images formed on image bearing member 1, and then toner images are transferred thereon from carrier 1 at a transfer nipping section of paired resist rollers 21. Paper transfer sheets P, which passed through the transfer nipping section are separated from the surface of image bearing member 1 by separation corona unit 82 and transferred to fixing apparatus 23 by conveyance belt 22.

Fixing apparatus 23, comprising heating roller 23*a*, within which a heater is housed, and pressing roller 23*b*, fixes toner images onto paper transfer sheets P, which holds toner images thereon by being heated and pressed between heating roller 23*a* and pressing roller 23*b*. Paper transfer sheets P on which toner images have been fixed are ejected by paired ejecting rollers 24 onto a storage tray provided outside of the machine. Cleaning unit 9 cleans off residual toner, after the transferring operation, from the surface of image bearing member 1.

The developing agent used for this embodiment will now be explained. In regard to developing agent J, single-ingredient developing agent and double-ingredient developing agent are acceptable. Regarding double-ingredient developing agent, polymerization toner including non-magnetic toner and magnetic carrier is recommended. By using a polymerized toner, image-forming apparatus producing high resolution and negligible overlapping of images due to stable photographic Density. The polymerization toner formed by polymerization between formation of binder resin for toner and toner particle shape, and raw material for binder resin or polymerization of pre-polymer and the chemical processing will be explained now.

Embodiment 1

The details of image developing apparatus 4 will now be explained. FIG. 1 is a cross sectional plan view (a) to show the center portion of each rotating member and a cross sectional side view (b) thereof at line A—A.

Image developing apparatus 4 comprising housing of image developing apparatus 40, stirring member 44, toner conveyance screw 45 and 46, developing agent supplying roller 47, developing sleeve 48 developing agent storage space 421, motor 404, and gear trains 402 and 403. Stirring member 44, toner conveyance screws 45 and 46, developing agent supplying roller 47 and developing sleeve 48A are rotating members.

The housing of image developing apparatus 40 comprised of flames and outer walls, comprises front portion 40*a*, central portion 40*b* and rear portion 40*c*. Front portion 40*a* is formed as a single box-shape and holds shaft bearings for each rotating member. Central portion 40*b* is also formed as a single box and toner conveyance screws 45 and 46, developing agent supplying roller 47, developing sleeve 48A and developing agent storage space 421, etc. are mounted therein. Further, rear portion 40*c* is formed as a single box and supports shaft bearings for each rotating member and gear trains. 41F is a lid of the image developing apparatus housing.

Space portion 43 corresponds to an exterior space of the image developing apparatus, provided between a first space between front potion 40*a* and central portion 40*b*, and a second space between rear portion 40*c* and central portion 40*b*.

Stirring member 44 is a rotating member having plural panel members, which are inclined to the shaft of rotating member 44, attached to the shaft approximately parallel to each other and stirs developing agent by rotating with the shaft. Toner conveyance screws 45 and 46 are rotating members and coveys the developing agent by the rotation. Further, developing agent supply roller 47 is a rotating member to supply the developing agent to developing sleeve 48A via its rotation. In regard to the driving mechanism, as motor 404 rotates, stirring member 44, toner conveyance screws 45, 46, developing agent supplying roller 47 and developing sleeve 48A rotate via gear train 403, connecting section 405 and gear train 403.

Developing sleeve 48A bears developing agent and conveys the developing agent to a developing area positioned opposite to image bearing member 1, which rotates and carries the developing agent. Exposed portion 48*c* radiates heat from developing sleeve 48A. The details of the configuration is that range L1 and L2 of exposed portion 48*c* are exposed to radiate heat. Being a cooling device, 48*d* is the surface of developing sleeve 48A, and range L2 is a portion to carry the developing agent. Developing agent-leveling member 49 (refer to FIG. 1) forms the developing agent carried on developing sleeve 48A into a thin developing layer. Developing agent-leveling member 49 shown in FIG. 1, limits the thickness of the developing layer of developing agent J by the gap formed between the surface of developing sleeve 48A and the top of developing agent-leveling member 49.

Sealing member S is shaped in a ring structure to prevent the developing agent, adjacent to holding portion of the rotating member rotatably supported by the housing of the developing apparatus, from leaking from the housing. Sealing member S is composed of a super-micro-molecule polyethylene material or magnetized material, which attracts the developing agent, and is attached at both ends of the rotating member.

The heat radiating action of the image developing apparatus will now be explained. Stirring member 44, toner conveyance screws 45 and 46, developing agent supplying roller 47 and developing sleeve 48A are rotated via gear train 403, jointing section 405 and gear train 402 as motor 404 rotates. On the other hand, stirring member 44 stirs the developing agent supplied by toner hopper 7 to the developing apparatus. The developing agent is conveyed by toner conveyance screws 45 and 46, and is further conveyed to developing sleeve 48A by developing agent conveyance roller 47. During this time, heat generated by the shaft bearing portion, heat generated by motor 404 and heat generated by the friction between the developing agent and the rotating member etc. is generated. The temperature of developing sleeve 48A tends to be raised by this heat. However, exposed portion 48C of developing sleeve 48A naturally radiates some of the heat away, and it retards melting of the developing agent, causes adhesion and causes its degradation due to the heat.

Embodimet 2

The second embodiment of the present invention is that the exposed portion of the developing sleeve of the first embodiment of the present invention is replaced by a forced air-cooling. The same structural components of the first and second embodiments have the same symbol and only the different portions will be explained. FIG. 3 is a cross-sectional plan view (a) showing a cross section of the rotating members of another developing apparatus structure, and the cross section A—A is cross sectional side view (b) of the rotating members. In FIG. 3, cooling device 5 comprises duct 51 and fan 52. Duct 51 covers from exposed portion 48C to fan 52 of the both ends of developing sleeve 48A. Fan 52 forces cool air onto exposed portion 48C to cool and exhaust the heated air.

The radiation action of the image developing apparatus will now be explained. Stirring member 44, toner conveyance screws 45 and 46, developing agent supplying roller 47 and developing sleeve 48A are rotated via gear train 403, jointing section 405 and gear train 403 as motor 404 rotates. The developing agent is conveyed to image bearing member 1 by developing sleeve 48A. During this time, heat caused by the shaft bearing, heat generated by motor 404 and heat generated by the friction between the developing agent and the rotating member, etc. is generated. The temperature of developing sleeve 48A tends to be raised by the heat. However, airflow generated by fan 52 reduces the heat by drawing the air and exhausting it to the outside of the image forming apparatus via duct 51.

Based on the structure above, developing agent is prevented from melting and adhering onto the surface of the developing sleeve, and being degraded due to the heat.

Embodiment 3

Figure 4:
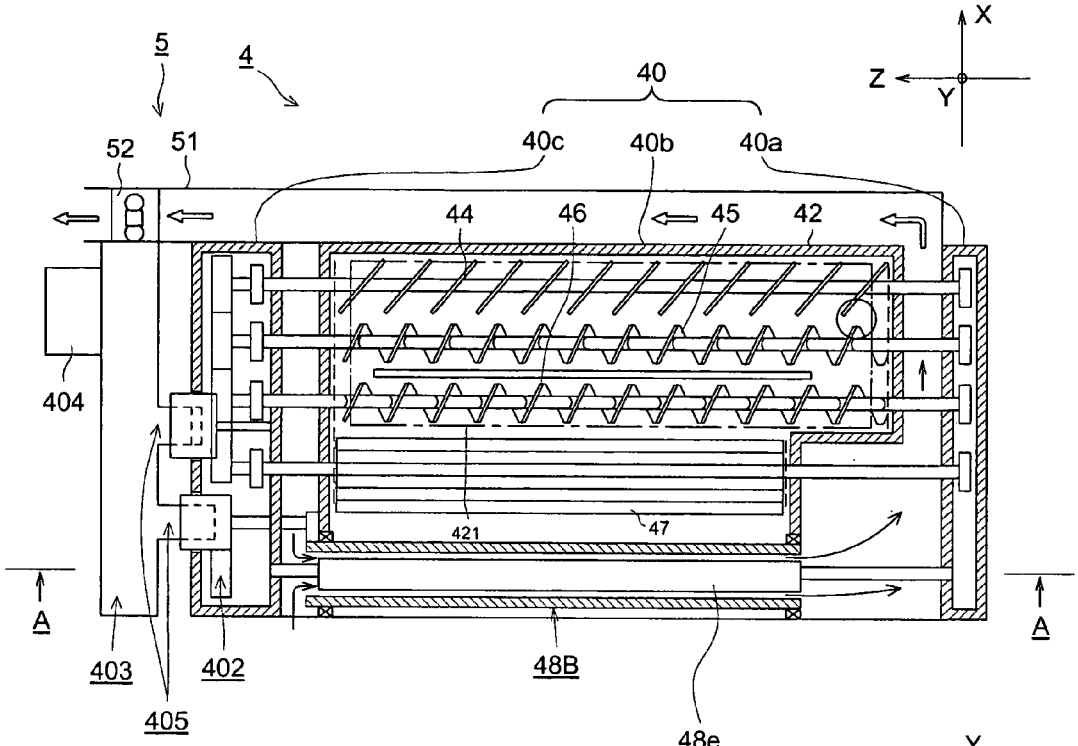
FIG. 4 is a cross-sectional plan view (a), showing a cross section of a rotating member of another image developing apparatus structure and cross section AA of cross sectional side view (b) of the rotating member.
Figure 4:
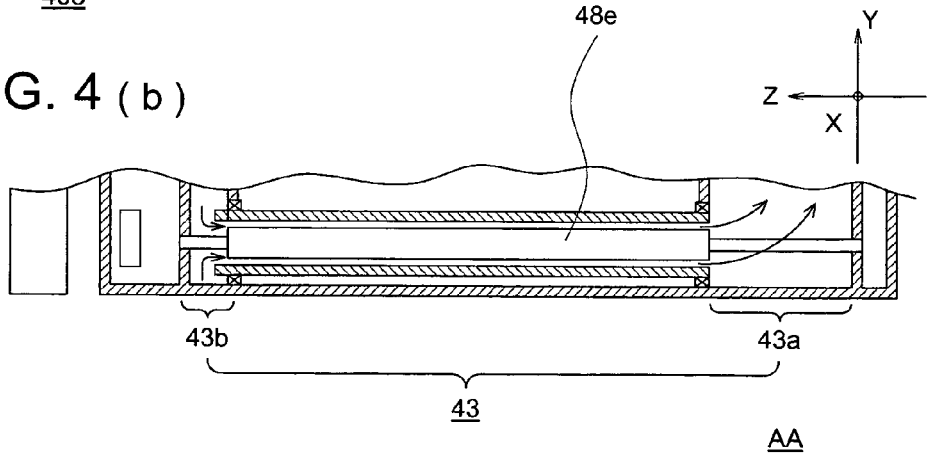

In the third embodiment of the present invention, developing sleeve 1 of the first embodiment is arranged as a cylindrical structure, which facilitates forced air-flow through the interior of the cylindrical developing sleeve. The same structural portions of the first and third embodiments have the same symbol and any different portions will be explained later. FIG. 4 shows a cross-sectional plan view (a), showing a cross section of a rotating member of another developing apparatus structure and cross section A—A is a cross sectional side view (b) of the rotating members. In FIG. 4, developing sleeve 48B is structured as a cylinder. Fixed magnet 48*e* is provided inside the cylindrical structure. Cooling device comprises duct 51 and fan 52, and duct 51 covers the area from developing sleeve 48B to fan 52. Fan 52 forces cool air between the internal surface of cylindrical developing sleeve 48 and fixed magnet 48*e*, to exhaust the heated air.

Now the heat radiating action of the image developing apparatus will be explained. Stirring member 44, toner conveyance screws 45 and 46, developing agent supplying roller 47 and developing sleeve 48B are rotated via gear train 403, jointing section 405 and gear train 403 as motor 404 rotates. During this time, heat caused by the shaft bearing portion, heat generated by motor 404 and heat generated by the friction between the developing agent and the rotating member, etc. is generated. The temperature of developing sleeve 48B tends to be raised by this heat. However, duct 51 and fan 52 draw the heat from inside of the cylindrical structure of developing sleeve 48B to the exterior of the image forming apparatus.

Based on the structure above, the developing agent is prevented from melting and adhering onto the surface of the developing sleeve, and being degraded due to the heat.

In the first and second embodiments of the present invention, examples that the exposed portions are provided on the surface of developing sleeve to radiate heat associated therewith are explained. However, the embodiments are not limited to these examples. For example, exposed portions can be provided not only on the developing sleeve but also on developing agent supplying roller 47. It is also possible to prevent developing agent from melting and adhering on the surface of developing agent supply roller and to ensure the supply of developing agent to the developing sleeve by providing exposed portions on developing agent supplying roller 47.

According to the embodiments disclosed above, the following results have been obtained.

It became possible that the development agent is prevented from melting and adhering to rotating member such as the developing sleeve. Also the temperature rise of the development agent can be suppressed, consequently high quality, uniform and stable development agent can be maintained.

The temperature-rise of the rotating member, adhesion of the developing agent on the rotating member and the temperature rise of the developing agent has been suppressed. This is because, the exposed portion of the rotating member rotatably supported by the housing of the image developing apparatus, which does not carry any developing agent, radiates heat of the rotating member from the housing of the image developing apparatus.

At least it has become possible that developing agent is prevented from melting and adhering to the developing sleeve and a rotating member, which is one of the developing agent carrying roller.

It has become possible to prevent the developing agent from leaking outside by providing a sealing member to prevent developing agent from leaking from the image developing apparatus adjacent to a portion where the rotating member is provided in the housing in the image developing apparatus, since the material of the sealing member is made from a super micro-molecule polymer or magnetic material, which absorbs the developing agent.

It has become possible to assuredly cool the rotating member by providing a cooling device to forcefully cool the exposed portions, in the housing of the developing apparatus.

It has become possible to assuredly cool the image-developing sleeve by providing a forced-air cooling device to blow cooling air inside the cylindrical image-developing sleeve.

It has become possible to assuredly prevent the developing agent from leaking from the housing by providing a sealing member adjacent to portions where the rotating member is rotatably supported in the housing of the image developing apparatus since the material of the sealing member is a super micro-molecule polymer or magnetic material, which attracts the developing agent.

It has also become possible to provide an image forming apparatus, which can maintain high quality, uniform, and stable images since the image developing apparatus of the present invention has been integrated to the image forming apparatus.

What is claimed is:

1. An image developing apparatus to develop a latent image in a developing area on an image bearing member, comprising:

a housing to store developing agent; and a rotating member rotatably supported in the housing and to convey developing agent to the developing area, wherein the rotating member includes a toner bearing portion and a part of the rotating member which is extended and exposed to the outside of the housing so that the exposed portion of the rotating member radiates heat accumulated in the rotating member, and wherein the rotating member includes at least one of a developing sleeve and a developing agent supplying device.

2. The image developing apparatus as in claim 1 wherein the developing agent supplying device is a roller to carry developing agent to a developing sleeve.

3. The image developing apparatus as in claim 1 wherein a sealing member to prevent developing agent from leaking from the developing apparatus is provided adjacent to a portion where the rotating member is rotatably supported in the housing of the developing apparatus.

4. The image developing apparatus as in claim 3 wherein the sealing member is polyethylene material or magnetic material, which attracts developing agent.

5. The image developing apparatus as in claim 1 including a forced-air-cooling device to cool the exposed portion of the rotating member.

6. The image developing apparatus as in claim 5 wherein the rotating member is shaped in cylindrical and a forced-air-cooling device to cool the part of the cylindrical rotating member by bowing cool air to the inside of the cylindrical.

7. The image developing apparatus as in claim 6 wherein the rotating member includes both of the developing sleeve and the developing agent supplying device.

8. The image developing apparatus as in claim 7 wherein a sealing member to prevent developing agent from leaking outside of the developing apparatus is provided adjacent to a portion where the rotating member is rotatably supported in the housing of the developing apparatus.

9. The image developing apparatus as in claim 8 wherein the sealing member is polyethylene material or magnetic material, which attracts developing agent.

10. An image forming apparatus including the image developing apparatus as in claim 1.

11. The image forming apparatus as in claim 10 wherein a sealing member to prevent developing agent from leaking from the developing apparatus is provided adjacent to a portion where the rotating member is rotatably supported in the housing of the developing apparatus.

12. The image forming apparatus as in claim 11 wherein the sealing member is polyethylene material or magnetic material, which attracts developing agent.

13. The image forming apparatus as in claim 10 including a forced-air-cooling device to cool the extended portion of the rotating member.

14. The image forming apparatus as in claim 13 wherein the rotating member is shaped in cylindrical and a forced-air-cooling device to cool the part of the cylindrical rotating member by blowing cool air to the inside of the cylindrical rotating member.

15. The image forming apparatus as in claim 14 wherein the rotating member includes both of the developing sleeve and the developing agent supplying device.

16. The image forming apparatus as in claim 15 wherein a sealing member to prevent developing agent from leaking from the developing apparatus is provided adjacent to a portion where the rotating member is rotatably supported in the housing of the developing apparatus and the sealing member is polyethylene material or magnetic material, which attracts developing agent.

17. An image developing apparatus to develop a latent image in a developing area on an image bearing member, comprising:

a housing to store developing agent;

a rotating member rotatably supported in the housing and to convey developing agent to the developing area; and a driving force transmitting device to transmit driving force to the rotating member; wherein a space is provided between the driving force transmitting device and the housing to store developing agent, wherein the rotating member includes a toner bearing portion and a part of the rotating member which is extended and exposed to the outside of the housing so that the exposed portion of the rotating member radiates heat accumulated in the rotating member, and wherein the rotating member includes at least one of a developing sleeve and a developing agent supplying device.

18. The image developing apparatus as in claim 17 wherein a sealing member to prevent developing agent from leaking from the developing apparatus is provided adjacent to a portion where the rotating member is rotatably supported in the housing of the developing apparatus.

19. The image developing apparatus as in claim 18 wherein the sealing member is polyethylene material or magnetic material, which attracts developing agent.

20. The image developing apparatus as in claim 17 including a forced-air-cooling device to cool the exposed portion of the rotating member.

21. The image developing apparatus as in claim 20 wherein the rotating member is shaped in cylindrical and a forced-air-cooling device to cool the part of the cylindrical rotating member by blowing cool air to the inside of the cylindrical rotating member.

22. The image developing apparatus as in claim 21 wherein the rotating member includes both of the developing sleeve and the developing agent supplying device.

23. The image developing apparatus as in claim 22 wherein a sealing member to prevent developing agent from leaking outside of the developing apparatus is provided adjacent to a portion where the rotating member is rotatably supported in the housing of the developing apparatus.

24. The image developing apparatus as in claim 23 wherein the sealing member is polyethylene material or magnetic material, which attracts developing agent.

25. The image developing apparatus as in claim 17 wherein the space provide between the driving force transmitting device and the container to storage developing agent is used to cool a rotating member.

* * * * *